United States Patent [19]

Revett

[11] Patent Number: 4,531,583

[45] Date of Patent: Jul. 30, 1985

[54] CEMENT PLACEMENT METHODS

[75] Inventor: Lowell W. Revett, Youngsville, La.

[73] Assignee: Halliburton Company, Duncan, Okla.

[21] Appl. No.: 473,832

[22] Filed: Mar. 9, 1983

Related U.S. Application Data

[63] Continuation-in-part of Ser. No. 282,115, Jul. 10, 1981, abandoned.

[51] Int. Cl.[3] ..... E21B 33/138; E21B 47/04

[52] U.S. Cl. ..... 166/253; 166/290; 166/291; 166/297

[58] Field of Search ..... 166/253, 285, 289, 290, 166/291, 297, 298, 306, 55, 55.1

[56] References Cited

U.S. PATENT DOCUMENTS

| | | | |
|---|---|---|---|
| 2,054,353 | 9/1936 | Yowell | 166/289 X |
| 2,222,233 | 11/1940 | Mize | 166/290 X |
| 2,344,120 | 3/1944 | Baker | 166/289 |
| 2,451,520 | 10/1948 | Teplitz | 166/253 |
| 2,452,654 | 11/1948 | Hayes et al. | 166/297 X |
| 2,591,603 | 4/1952 | Ragan | 166/290 X |
| 2,813,584 | 11/1957 | Teplitz | 166/290 X |
| 2,842,205 | 7/1958 | Allen et al. | 166/285 |
| 3,026,936 | 3/1962 | Teplitz | 166/297 |
| 3,815,677 | 6/1974 | Pennebaker, Jr. | 166/253 |
| 4,074,756 | 2/1978 | Cooke, Jr. | 166/253 |

OTHER PUBLICATIONS

Halliburton Service Catalog No. 40, 1980, p. 3327.

Keller, S. R. et al., "Problems Associated with Deviated-Wellbore Cementing", SPE 11979, Presented at the 58th Annual Technical Conference and Exhibition Held in San Francisco, CA, Oct. 5-8, 1983.

Lane-Wells Co. Brochure, Printed in U.S.A. by George Rice & Sons 2750, Dec. 31, 1936.

*Tomorrow's Tools Today,* Published by the Lane-Wells Company, vol. V, No. 11, Oct. 1939.

*Primary Examiner*—George A. Suchfield

*Attorney, Agent, or Firm*—William J. Beard

[57] ABSTRACT

A method for use in a cased well bore for placing cement in a vertical channel existing in the annulus between the casing and a well bore to seal off vertical channels in a prior cement job. In the method, where a vertical channel exists, the interval of the casing along the vertical channel is perforated circumferentially with the perforations at 15° angles with respect to one another about a vertical axis. The perforations number can be as many as twenty-four over a six foot interval. The interval of the casing is located near a water bearing formation and between permeable zones. A known volume of cement is then pumped through the perforations and into the vertical channel to seal off the annulus between the casing and the well bore and excess cement is reverse circulated out of the well bore.

6 Claims, 5 Drawing Figures

CEMENT PLACEMENT METHODS

This application is a continuation-in-part of copending application Ser. No. 282,115 filed July 10, 1981, now abandoned.

FIELD OF THE INVENTION

This invention relates to cement placement techniques for oil and gas wells, and more particularly, to cement placement techniques in which effective circumferential penetrations are used to intersect vertical channels in a cemented annulus so that cement can be introduced into such vertical channels for sealing off the annulus between a well casing and a well bore traversing earth formations.

BACKGROUND OF THE INVENTION

In the completion of a well, it is customary to use one or more casings or liners in a well bore. For each casing or liner, cement is pumped upwardly in the annulus between the outer wall of the casing and well bore to seal off the annulus and prevent the vertical migration of liquids along the casing in a well bore. For one reason or another, after the cementing job is completed it is not uncommon to have vertical channels or other voids in the cement in the annulus. Sometimes, the channels appear after production. In any event, in dual zones particularly, the production of water from a lower zone can migrate through a vertical channel and be produced from the upper zone. This is a highly undesirable situation.

Heretofore, cement squeeze techniques for remedial and intermediate cementing operations in well bores have been used in an attempt to seal off the channels in a cemented annulus. Typically, a squeeze cementing operation begins by isolating the perforated interval of a well casing traversing earth formations and thereafter pumping a cement slurry through a tubing and below a cement retainer into perforations which are located along an interval of casing. The remedial operation is intended to remedy a prior cement job which has been ineffective by filling any voids existing in the prior cement job. The voids in the cement annulus characteristically are vertical and located in random order about a casing. Heretofore, the perforations for a squeeze cementing job routinely consist of two to eight shots ranging from one-half to two feet. The azimuthal angle between perforations has typically been at 0°, 90° or 120° phasing and the entrance hole size of the perforation was not considered to be of great importance.

In the prior art techniques, the success ratio of sealing off vertical channels has not been too successful. It has been estimated that one square inch of cross-sectional area in a vertical channel can accommodate the flow of several hundred barrels of water per day. For example, with a one-half inch diameter perforation in a seven inch casing, the probability of intersecting a small vertical channel in a cement annulus with a 90° phase gun is very small. Further, where a channel in a cement annulus contains mud or water and the perforation intersects the channel, the likelihood of introducing formation damage occurs during the squeeze operation.

Cement squeezing techniques involve a cement slurry which is pumped into a well casing through perforations in the casing. The cement slurry if successfully filling voids, may also come into contact with porous and permeable earth formations. At higher pressures, the water in the cement slurry is squeezed out of the cement slurry and partial hydraulic dehydration of the cement occurs. When the dehydrated cement becomes impermeable, it forms a seal in the annulus between the casing and the well bore. One of the problems associated with cement squeezing is the risk of damaging producing formations.

The likelihood of shutting off the water flow in a cement channel or void in the cement annulus also depends upon the squeeze cement first reaching the channel or void and thereafter flowing into the channel or blocking the channel. Heretofore, perforating the casing for the squeeze job in respect to the number of shots or their placement has never been a major consideration. Squeeze perforations in a casing typically consist of two to eight perforations placed in an interval ranging from one-half foot to two feet and an azimuthal angle between perforations of 0°, 90° or 120°. The probability of a typical perforating gun aligning with a channel or void in a cement annulus is not particularly great and the assumption that pressure will allow fluid to break into a channel is not always valid.

For example, if the channel has a one-square inch cross-section it may be capable of flowing several hundred barrels of water per day. Thus when the perforators produce perforations of one-half inch in size in four directions, only two inches of the pipe circumference are perforated. The circumference of a 7" casing is 21.99" and that of a 9⅞" borehole is 31.02", which illustrates the small likelihood of intersecting a small vertical channel.

Assuming that a perforation penetrates a vertical channel in the cement annulus, there is a likelihood that the channel is filled with drilling mud or dirty water which possesses some of the characteristics of a cement slurry and will partially dehydrate at the interface of a permeable and porous foundation when subjected to higher pressure. Unless the channel continues to the surface, the applied pressure will cause dehydration and the formation of a low permeability barrier or seal at the channel and formation face so that the channel is hydraulically sealed to high volume flow rates. Under these conditions, neither the channel nor the perforation can transmit liquid at a high flow rate, but both transmit the resulting increase in hydraulic pressure to the formation. At some point the path of liquid flow is into the formation, where it breaks down or fractures creating a void where the mud, dirty water and/or cement slurries can be accommodated. The exact point where the liquids enter the formation is difficult, if not impossible, to determine, and the entry point may or may not be at the channel in the cement annulus.

The success or failure of a cement squeeze to shut off water does not preclude formation damage to a productive interval. The water squeeze from a cement slurry contains fine grain cement particles and will cause some formation damage by reducing the relative permeability if it enters the productive zone. The water alone may also reduce the permeability if the formation happens to be water sensitive. With repeated attempts to squeeze off water, the permeability can be continuously reduced and greater pressures be incurred so that the probability exists that the production could be shut off.

THE PRESENT INVENTION

The present invention, as contrasted to a cement squeeze, provides a directed path for cement flow into a vertical channel and does not hydraulically dehydrate the cement. This is accomplished by perforating a cement placement interval to effectively penetrate along the entire circumference of a casing. The perforations preferably are placed in a six-foot interval at an azimuthal angle of 15° at about four shots per vertical foot. If a 7" casing is perforated with 0.92" entrance hole charges, then twenty-four shots will cover 22.08" of the casing circumference at 21.99". Thus, the probability of intersecting a cement channel exterior to the casing is very high. After establishing the perforations, circulation through the channel behind the casing is established and a specific volume of cement is injected into the channel to shut off the channel and excess cement is thereafter reversed out of the well bore.

IN THE DRAWINGS

In the drawings, the illustrations of the present invention are as follows.

Figure 4B:
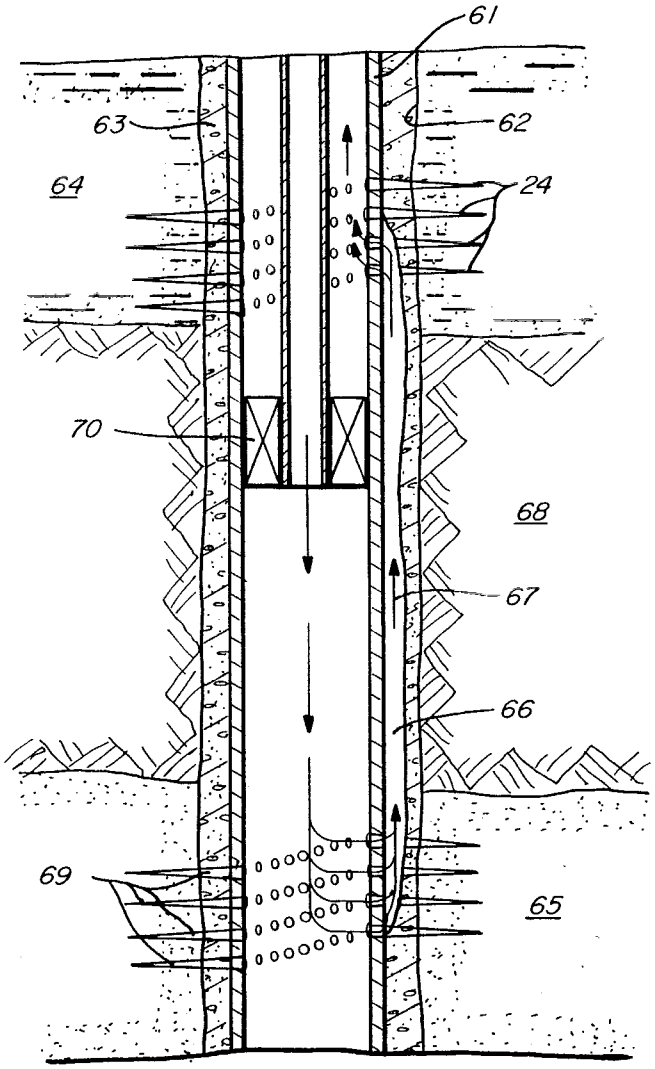
Figure 4A:
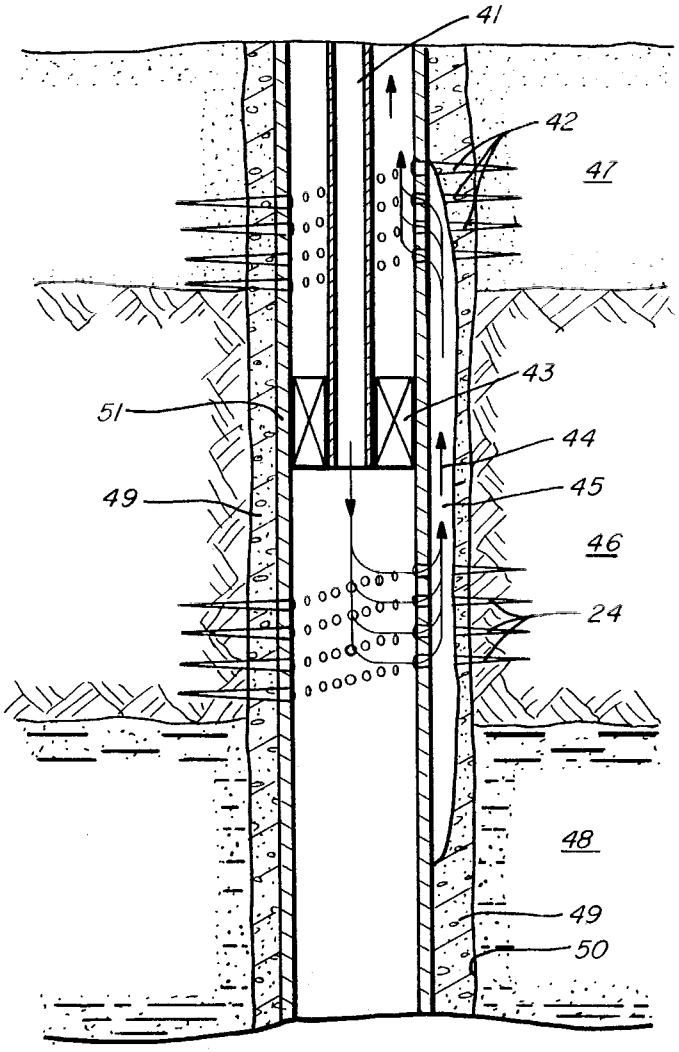

FIGS. 4*a* and 4*b* illustrate the technique of the present invention in the case of water production due to cement channelling from below and above a producing sand respectively.

DESCRIPTION OF THE INVENTION

Figure 1:
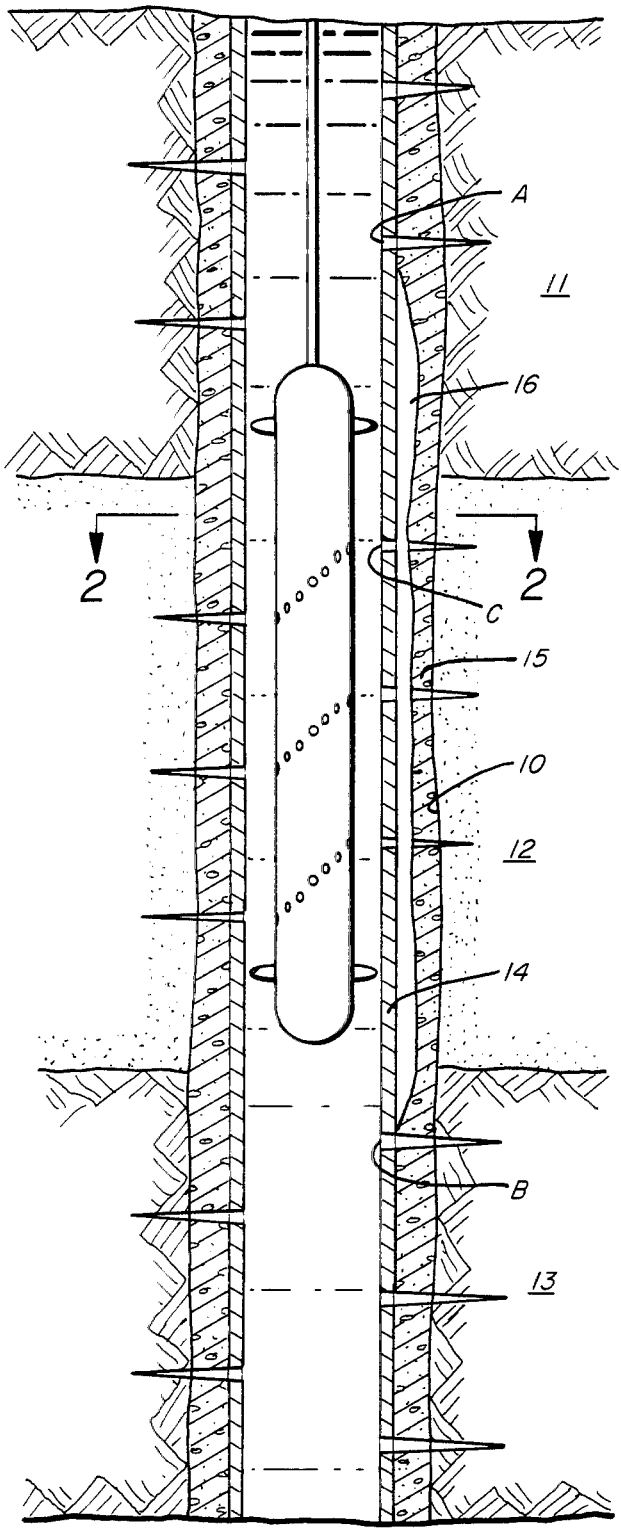
FIG. 1 is a schematic representation of a cased well bore containing a perforating apparatus intended to circumferentially perforate the casing.
Figure 2:
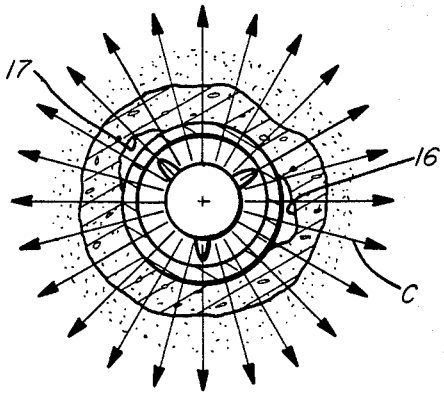
FIG. 2 is a schematic top view taken along line 2—2 of FIG. 1.

Referring now to FIGS. 1 and 2, well bore 10 is shown traversing earth formations 11, 12 and 13. Earth formations 11 is an oil producing formation having perforations A for producing fluids from the earth formations. Formation 13 is a water bearing zone and formation 12 is intermediate the water zone 13 and oil zone 11. Disposed in the borehole 10 is a tubular casing 14 which extends to the earth's surface and is connected to suitable production or control equipment (not shown). The annulus 15 between the casing 14 and the well bore 10 contains a column or annulus of cement which has been placed in the annulus through conventional cementing techniques. For the purposes of explanation of the present invention, it is assumed that vertical channels 16, 17 extend along the well casing 14 between the cement column in the annulus 15 and the casing 14 and that water production has been observed in the production from the well.

The first step in the process of the present invention is to fill the well with a mud control fluid and then perforate the cement placement interval to receive the cement placement. This interval is located preferably just above the water bearing zone. The interval to be perforated is perforated with a perforating gun having approximately four shots per vertical foot over an interval of not more than 6 feet with the perforating means in the perforating gun being arranged at 15° azimuthal direction so as to effectively perforate the entire circumference of the casing. The shaped charges are all fired substantially simultaneously. As shown in FIGS. 1 and 2, perforations C effectively cover the circumference of the casing. Perforating devices producing entrance holes, for example, as large as 0.92 inches may be used. The perforating means in the perforating gun preferably may have a spiral configuration along the length of the gun with angular displacements of 15° as noted before. A suitable apparatus and variations thereof is illustrated and explained in more detail in my copending application filed on July 13, 1981 in the U.S. Patent Office under the title, "Spiral Gun Apparatus" under Ser. No. 282,555, now abandoned.

After the perforations C are produced along the cement placement interval, in the second step of the process a cement retainer 20 is set above the perforated interval 13 and above or at the upper end of the placement perforations C. The cement retainer may be, for example, an "EZ DRILL" squeeze packer by Halliburton and illustrated in Halliburton Service Catalog No. 39 on page 3181. The squeeze packer can be set in a well bore so that a packing element 21 seals off the cross section of the casing and the bore of the packer is closed off by a pressure balanced sliding valve 22. When a stinger 23 is latched into the packer the valve 22 is opened.

A latchdown indicating type plug catcher 24 is located in a tubing string 25 just above the stinger 23. The tubing string 25 is connected at the earths surface to a pump (not shown). The tubing string 25 permits the introduction of fluids to the well bore.

Figure 3:
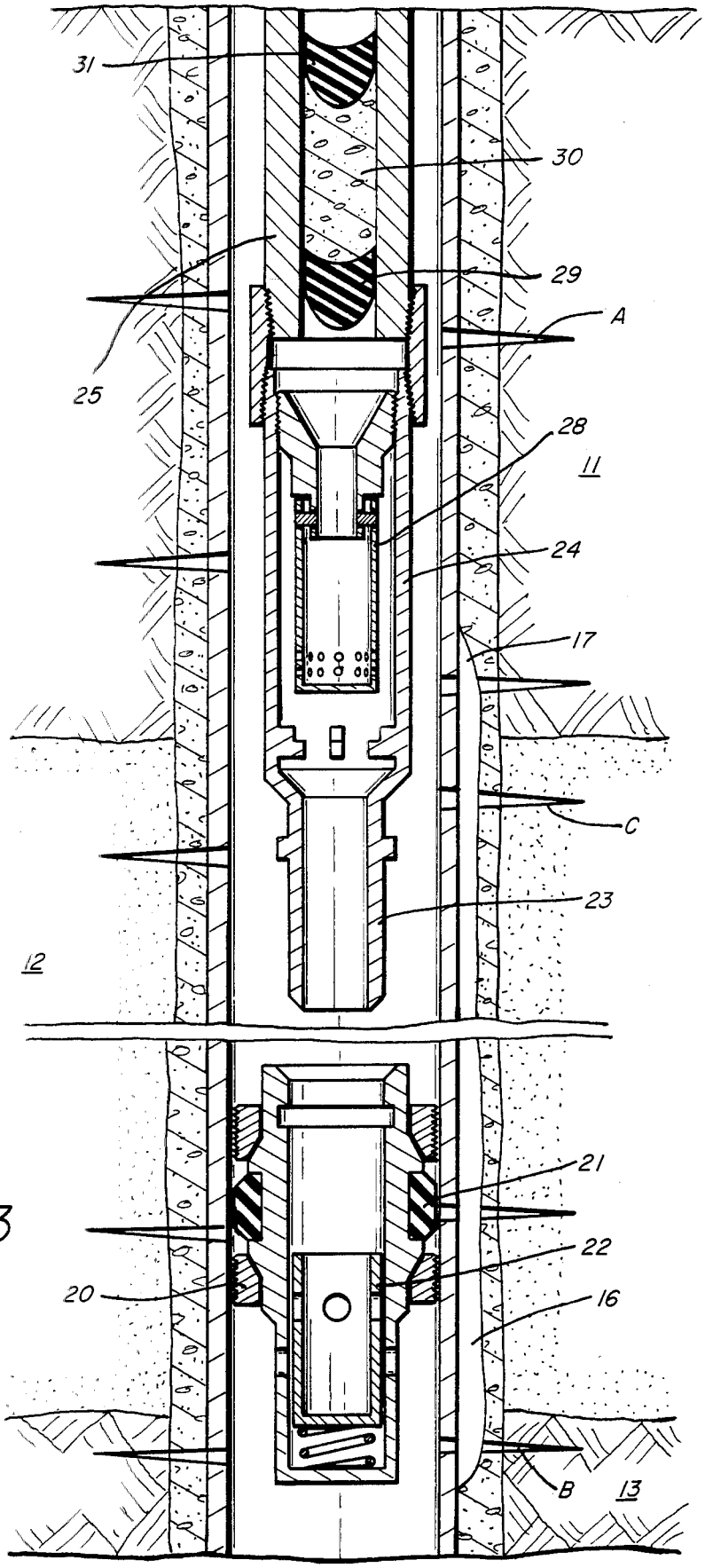
FIG. 3 is a schematic representation of a cased well bore containing cementing apparatus for achieving cement placement in a vertical channel.

After setting the cement retainer or squeeze packer 20 in position, the tubing string 25 with a plug catcher 24 and stinger 23 are located in the well as shown in FIG. 3. The latch-down indicating type plug catcher may be of the type offered by Halliburton in its Service Catalog No. 40 at page 3327. The plug catcher 24 has a shear pin connected sliding sleeve valve 28 which is adapted to indicate the arrival of a wiper plug 29 by the pressure build-up required to shear the pins holding sleeve 28 from its pinned or closed position. When the sleeve 28 is released, a cement slug 30 in the tubing bypasses, via the now open sleeve valve 28, and passes through the stinger 23.

After locating the stinger 23 on the tubing 25 in the well bore as shown in FIG. 3, the stinger 23 is engaged in the cement retainer 20 and fluid is pumped down the tubing 25 to establish circulation from the perforations B and C below the retainer 20 through the vertical channels 16, 17 through the perforations A above the cement retainer. After establishing circulation through the channels 16 and 17, the stinger 23 is withdrawn from the retainer 20 and approximately four barrels of low water loss cement 30 is pumped down the tubing immediately above the wiper plug 29. The cement 30 is pumped down until the bottom plug 29 engages the plug catcher 24 which produces momentary high pressure indication at the earth's surface as the plug catcher shear pin is sheared. After the plug 29 engages the catcher 24, the stinger 23 is re-inserted into the retainer 20 and the operator pumps only two barrels of cement into the channel and then disengages the stinger 23 from the cement retainer 20 so that the excess cement can be reversed circulated out of the casing. The cement required to fill the channel 16, 17 should therefore comprise the center portion of the cement slug 30. Thus, placing contaminated cement in the channel is avoided. Thereafter the tubing string 25 is retrieved and the cement allowed to set up at ambient pressure.

Referring now to FIGS. 4*a* and 4*b* the cement placement techniques of the present invention are illustrated in two possible geometric configurations. In FIG. 4*a* the producing sand 47 is located above the water sand 48 which is producing a water cut through a channel 45 in the cement sheath 49 surrounding the casing 51 in a cased well borehole. In this configuration production perforations 42 become contaminated by water flowing upward along the cement channel 45 and entering the well borehole through the production perforations 42, simultaneously with hydrocarbon produced from the producing sand 47. A perforating gun is lowered down the casing string 41 via a wireline and 6 feet of perforations from a spiral jet perforating gun as previously described are performed at 46 in the casing 51. As previously discussed, because of the geometrical arrangement of the spiral jet perforating gun, it is assured with high probability that the cement channel 45 will be intercepted by at least one and possibly more of the perforations performed by the 6 foot spiral jet gun having four perforations per foot and distributed in the spiral configuration with 15° phasing. This assures entirely circumferential perforation of the 7 inch casing 51 without cutting the casing off because of the spiral or helical configuration of the shape charges along the spiral jet gun. A cement retainer 43 of the type previously described with respect to FIG. 3 is run into the well bore and set above the perforated interval.

When the perforations 46 have been accomplished, fluid is circulated through the cement retainer 43, the perforations 46 and cement channel 45 into the annulus between tubing 41 and casing 51 in the borehole above the cement retainer as indicated by the arrow. When this has been accomplished, the techniques previously described with respect to FIG. 3 are utilized to place a precisely determined quantity of cement into the channel 45 exterior to the casing 51 by application through the cement retainer 43. Any excess cement entering casing 51 above the cement retainer 43 may then be back circulated out of the annulus by withdrawing the stinger 23 of FIG. 3 thereby closing sliding valve 22 in the retainer packer 21 in the manner previously described with respect to FIG. 3.

Thus a precise placement of a predetermined quantity of cement to seal off the flaw or channel 45 permitting water flow from the water sand 48 through the cement sheath 49 between the wall of the borehole 50 and the casing 51 is accomplished. Once this has been accomplished, a production packer can be set and production through the production perforations 42 resumed in a normal manner with the water sand 48 communication via cement channel 45 cut-off from the production perforations 42.

Referring now to FIG. 4*b* the geometrical configuration in which the contaminating water sand 64 is located above a producing sand 65 is illustrated schematically. A well borehole 62 is lined with a steel casing 61 surrounded by a cement sheath 63. A cement channel 66 exists connecting the producing sand 65 with the water sand 64 prior to applying the techniques of the present invention and permitting water contamination from the water sand 64 to reach production perforations 69 opposite the producing sand.

In this situation, a wireline perforating gun of the spiral jet type previously described and having a length of approximately 6 feet and spiral perforating charges spaced at an interval of 4 shaped charges to a foot distributed over this 6 foot length with 15° phase are used to produce a set of circumferential perforations in casing 61 at location 24 above the producing sand. A cement retainer 70 is then run in on the tubing string and set as previously described between the perforations 68 and the production perforations 69. Fluid flow is established through the channel 66 by pumping fluid down through the cement retainer. When this is accomplished a predetermined, relatively small amount of cement may be pumped through the tubing string in the manner previously described with respect to FIG. 3 and into the cement channel 66. The cement flow is illustrated by the arrow 67.

The cement will enter production perforations 69 in this case and flow upwardly through the cement channel 66 and back into casing 61 through the cementing perforations 68 provided by the spiral jet perforating gun. For the reasons herein described the perforations 68 are almost certain to intercept any existing cement channel 66 exterior to the casing 61. When a predetermined quantity of cement has entered the cement channel 66 and flowed upwardly therethrough, the tubing string stinger 23 of FIG. 3 may be removed from the cement retainer 70 and any excess cement back circulated in the manner described with respect to FIG. 3. Thus precise placement of the cement in the channel 66 from the production perforations 69 to the cementing perforations 68 may be accomplished.

It should be noted in both of these possible geometrical configurations that the cement retainer is each time placed between a set of perforation produced by an approximately 6 foot long spiral jet perforating gun having approximately 4 perforations per foot and providing a net azimuthal distribution of perforations every 15° along the casing (as shown in FIG. 2) and a set of production perforations which have been allowing water cut hydrocarbon to enter the well borehole for production. The perforations from the spiral jet perforating gun are always placed on the side of the producing sand from which it is suspected that water is entering via a cement channel (i.e. between the suspected water bearing formation and the production perforations).

Such water sands typically can be detected in well logging operations prior to the setting of casing such as by electrical well logging. Other cased hole logging techniques, such as nuclear techniques, can be used to detect water bearing formations after casing is set and cemented. In this manner it will generally be known on which side of a producing sand a water sand which is possibly producing a water cut along a cement channel will be located. Thus, it will be possible, in general, to determine whether to perforate for the cement placement purpose above or below the producing sand. This will also determine the location of the cement retainer used in the cementing process according to the techniques of the present invention.

It will further be noted that, in any event, the techniques of the present invention provide an effective means with a high probability of intercepting a cement channel with perforations and pumping a precisely measured quantity of cement for placement in the channel. Excess cement can then be circulated from the borehole following the operation. As previously mentioned, the advantages of this technique include the prevention of formation damage which may possibly be caused by squeeze cementing techniques of a standard nature in which a high hydraulic head pressure is required. Formation damage such as lowering permeability and contamination from cement are dehydrated cement is thus prevented by the use of the techniques of the present invention.

The foregoing descriptions may make other alternatives arrangements apparent to those skilled in the art. It is the aim of the appended claims to cover all such changes and modifications as fall within the true spirit and scope of the invention.

I claim:

1. A method for placing cement in vertical channels or voids in a cement sheath between the casing and borehole wall in a cased well borehole in which undesirable water cut is entering production perforations from a suspected water bearing formation above or below a producing formation via such vertical channels or voids, comprising the steps of:

perforating the casing of the borehole to produce intersecting perforations at a location between said production perforations and said suspected water bearing formations over a vertical interval of the casing sufficient to allow substantially the entire circumference of the casing to be perforated by a spiral arrangement of shaped charge perforating charges arranged in substantially a 15° azimuthal phasing relationship to each other and approximately centered in the casing, said shaped charges having entrance holes into the casing of sufficient diameter and being vertically spaced apart over said vertical interval of casing to assure a high probability of intersecting any vertical channel or voids in said cement sheath to be intersected by at least one such shaped charge perforations at some level in said vertical interval;

running a cement retainer packer into the casing on a tubing string and setting said cement retainer in the casing between the production perforations and the intersecting perforations;

establishing a fluid circulation path for fluid exterior to the casing from said intersecting perforations to said production perforations by pumping fluid at relatively low pressure down said tubing string and through said cement retainer in one set of said perforations, through said vertical channels or voids in the cement sheath and into the other of said set of perforations on the opposite side of said cement retainer; and placing a relatively small predetermined quantity of cement into said vertical channels or voids by pumping said relatively small predetermined quantity of cement at said relatively low pressure in said fluid circulation path.

2. The method of claim 1 wherein the step of placing said relatively small predetermined quantity of cement is performed by pumping a slug of cement having said predetermined quantity down said tubing string behind a wiper plug and using a latchdown indicating type plug catcher to indicate the arrival of said cement slug at said cement retainer, and thereafter pumping only a predetermined volume of fluid down said tubing to force said predetermined quantity of cement into place in said cement channels or voids.

3. The method of claim 1 wherein the well casing comprises 7 inch casing and said perforating step is performed with a perforating gun approximately 6 feet in length and having 24 shaped charges distributed vertically therein having a spiral exit hole configuration and being vertically spaced 4 charges to the foot at a 15° phasing angle about a vertical axis of said gun and wherein said charges are all fired substantially simultaneously.

4. The method of claim 1 wherein the suspected water bearing formation is above said producing formation and said intersecting perforations and said cement retainer are employed above said production perforations in the wellbore.

5. The method of claim 1 wherein the suspected water bearing formation is below said producing formation and said intersecting perforations and said cement retainer are employed below said production perforations in the wellbore.

6. The method of claim 1 wherein the pumping pressures employed are substantially below the break down pressure for fracturing of the earth's formation.

* * * * *